United States Patent [19]

Jones

[11] Patent Number: 4,776,411

[45] Date of Patent: Oct. 11, 1988

[54] FLUID FLOW CONTROL FOR DRAG BITS

[75] Inventor: Kenneth W. Jones, Kingwood, Tex.

[73] Assignee: Smith International, Inc., Newport Beach, Calif.

[21] Appl. No.: 28,990

[22] Filed: Mar. 23, 1987

[51] Int. Cl.[4] ..... E21B 10/60

[52] U.S. Cl. ..... 175/393; 175/329

[58] Field of Search ..... 175/329, 339, 340, 393, 175/417, 418, 394, 395, 410

[56] References Cited

U.S. PATENT DOCUMENTS

| | | | |
|---|---|---|---|
| 2,838,284 | 6/1958 | Austin | 175/329 |
| 3,095,935 | 7/1963 | Hildebrandt et al. | 175/393 |
| 3,322,218 | 5/1967 | Hildebrandt | 175/330 |
| 4,246,977 | 1/1981 | Allen | 175/329 |
| 4,253,533 | 3/1981 | Baker, III | 175/329 |
| 4,350,215 | 9/1982 | Radtke | 175/329 |
| 4,359,335 | 11/1982 | Garner | 175/410 |
| 4,397,363 | 8/1983 | Fuller | 175/410 |
| 4,492,277 | 1/1985 | Creighton | 175/329 |
| 4,515,227 | 5/1985 | Cerkovnik | 175/393 |
| 4,538,691 | 9/1985 | Dennis | 175/393 |
| 4,550,790 | 11/1985 | Link | 175/329 |

*Primary Examiner*—Jerome Massie, IV
*Assistant Examiner*—Bruce M. Kisliuk
*Attorney, Agent, or Firm*—Robert G. Upton

[57] ABSTRACT

A drag type drilling bit having a plurality of radially disposed raised lands on the bit face is disclosed. A multiplicity of polycrystalline diamond compacts are strategically disposed on the raised lands. At least a pair of lands are joined at the outside periphery of the bit thereby closing the valley formed between the lands, thus forming a plenum for drilling fluid that exits the bit interior through ports or nozzles communicating therewith. Highly turbulent fluid confined in the plenum continually scrubs and scavenges the hole bottom while simultaneously and uniformly cooling and cleaning the PDC cutters during operation of the bit in a borehole.

6 Claims, 3 Drawing Sheets

FLUID FLOW CONTROL FOR DRAG BITS

BACKGROUND OF THE INVENTION

1. Field of the Invention

This invention is related to diamond type drag bits that utilize hydraulic energy to enhance earth formation penetration rates.

More particularly, this invention relates to diamond type drag bits having a superior means to utilize hydraulic energy passing through the bit to cool and clean as well as scavenge a borehole bottom during rock bit operation.

2. Description of the Prior Art

There are a number of diamond type drag bit patents that address the problem of cooling and cleaning diamond cutting elements during rock bit operation.

For example, U.S. Pat. No. 4,253,533, assigned to the same assignee as the present invention, describes a diamond studded insert drag bit having a multiplicity of individual diamond insert cutter blanks inserted in the face of the bit. The diamond insert blanks are so positioned to maximize penetration of the bit in a borehole. The bit further includes a pair of wear pads adjacent the several diamond insert cutter blanks, the wear pads serving to limit the insert penetration depth while channeling the flow of drilling mud emanating from fluid passages formed in the face of the bit. The wear pads seal off a portion of the borehole bottom, thereby directing hydraulic fluid across the face and over each of the strategically positioned diamond cutter blanks.

While this patent has proven satisfactory in operation, it has not provided an even distribution of cross-flow fluid to each of the diamond cutter blanks. For example, energy velocity is dissipated as flow reaches the outer peripheral edge of the bit, thus some of the insert blanks near the gage of the bit tend to be more effected by heat buildup and the like.

Another patent, U.S. Pat. No. 4,246,977, also assigned to the same assignee as the present invention, describes a diamond studded insert drag bit having a multiplicity of individual diamond insert cutter blanks inserted in the face of the bit. The diamond blanks are so positioned to maximize penetration of the bit in a borehole. The bit further includes fluid passages strategically located in the bit face to provide uniform flow, cooling, and continuous cleaning of each of the diamond cutter insert blanks. The fluid passages are so sized to cause minimum bit pressure drop. While this invention did evenly distribute fluid over the diamond cutters, the design did not adequately scavenge the borehole bottom to efficiently remove detritus therefrom.

Another prior art patent, U.S. Pat. No. 4,492,277, describes a drag bit for drilling a rock formation having a bit face matrix for supporting a plurality of cutters, the matrix having one or more fluid passages for discharging a fluid to flow over the bit face. To enhance the cooling and cleaning of the plurality of cutters, the bit face matrix includes a "crow's foot" type port that directs fluid into a restricted area formed between the bit face and the formation. A high velocity radial fluid flow across the bit face matrix is the desired effect. The fluid flow prevents debris from accumulating on the plurality of cutters thus providing cooling thereof. The patent teaches improved fluid distribution. A spiraling type dam structure is illustrated that extends from the nozzle radially outward over most of the bit face matrix.

This patent does not provide a uniform flow of fluid from the crow's foot fluid opening to each of the cutters randomly positioned on the face of the bit.

The present invention overcomes the shortcomings of the foregoing prior art patents by providing large plenum chambers in the cutting face of the bit which are adapted to receive fluid from the interior of the drag bit, thus providing better than fifty percent borehole bottom coverage with high pressure drilling fluid. A series of diamond cutters are mounted on the raised lands that defines and forms each plenum chamber. The highly turbulent fluid confined within the plenum chambers is then uniformly accelerated past each of the diamond cutters mounted on the raised lands. The abundance of turbulent hydraulic energy made available by the large plenum chambers serves to more aggressively scavenge the borehole bottom of detritus while simultaneously cleaning and cooling each of the diamond cutters mounted in the raised lands. Moreover, the plenum chambers, being surrounded by closely spaced cutter elements, enable a multiplicity of diamond cutters to be positioned adjacent the gage of the borehole, thus providing good rock formation penetrating qualities while providing superior gage cutting capabilities.

SUMMARY OF THE INVENTION

It is an object of this invention to provide a diamond drag bit having superior hole cleaning and diamond cutter cooling capabilities, thereby enhancing rock bit penetration.

More particularly, it is an object of this invention to provide a diamond drag bit having one or more plenum chambers to accept fluid directed to the chamber, the plenums being surrounded by raised lands that support a multiplicity of diamond cutters thereon. Fluid is accelerated uniformly past each of the diamond cutters thereby cooling and cleaning each of the cutters.

The drag type drilling bit of the present invention consists of a bit body that forms a first pin end and a second cutting end. The first pin end is opened to a source of drilling fluid that is transmitted through an attachable drillstring. The pin end communicates with a fluid chamber that is formed by the bit body. One or more radially disposed raised lands are formed by the second cutting end of the bit. The raised lands are joined near a centerline of the bit and adjacent an outer peripheral edge of the bit body thereby forming at least one plenum chamber thereby. A multiplicity of diamond cutting elements are strategically positioned and fixedly attached to the raised lands. One or more ports are formed in the second cutting end of the bit body, the ports communicating between the chamber formed within the bit body and the plenum chamber formed by the raised lands. Fluid or drilling mud exits the ports and is distributed within the plenum chamber, thereby scavenging a borehole bottom while uniformly cooling and cleaning the multiplicity of diamond cutting elements during drag bit operation.

The aforementioned drag bit may have three plenum chambers that are shaped in a spiral pattern such that each plenum chamber forms a first leading edge and a second trailing edge. The bottom of the plenum chamber formed by the face of the rock bit may vary in depth, tapering from a leading edge portion towards a trailing edge portion. Fluid entering the plenum chamber is accelerated from the leading edge toward the trailing edge through the constricted space formed between the plenum chamber and the borehole bottom. A series of axially oriented slots are formed in a wall of the bit body. Fluid and debris escaping the plenum chambers is directed along these slots back to the rig floor. In addition, a series of spirally oriented low pressure troughs may be formed on the face of the bit in parallel with the plenum chambers. The low pressure troughs transport fluid and detritus out of the plenums to relatively large axially aligned debris slots also formed in the wall of the rock bit body to act as a means to transport a majority of the borehole cuttings up the drillstring.

An advantage then over the prior art is the means in which fluid is accelerated past the diamond cutters in a uniform fashion, thus providing a superior means to scavenge the borehole bottom while also providing a cooling and cleaning function to each and every one of the cutters mounted in the raised lands portion surrounding the plenum chambers.

Yet another advantage of the present invention over the prior art is the ability to apply much more diamond cutting elements on the gage of the bit. About one quarter of the multiplicity of closely spaced diamond cutters attached to the raised lands are positioned on gage, the remainder of the cutters completing the loop around the plenum chambers.

The above noted objects and advantages of the present invention will be more fully understood upon study of the following description in conjunction with the detailed drawings.

DESCRIPTION OF THE PREFERRED EMBODIMENTS AND BEST MODE FOR CARRYING OUT THE INVENTION

Figure 1:
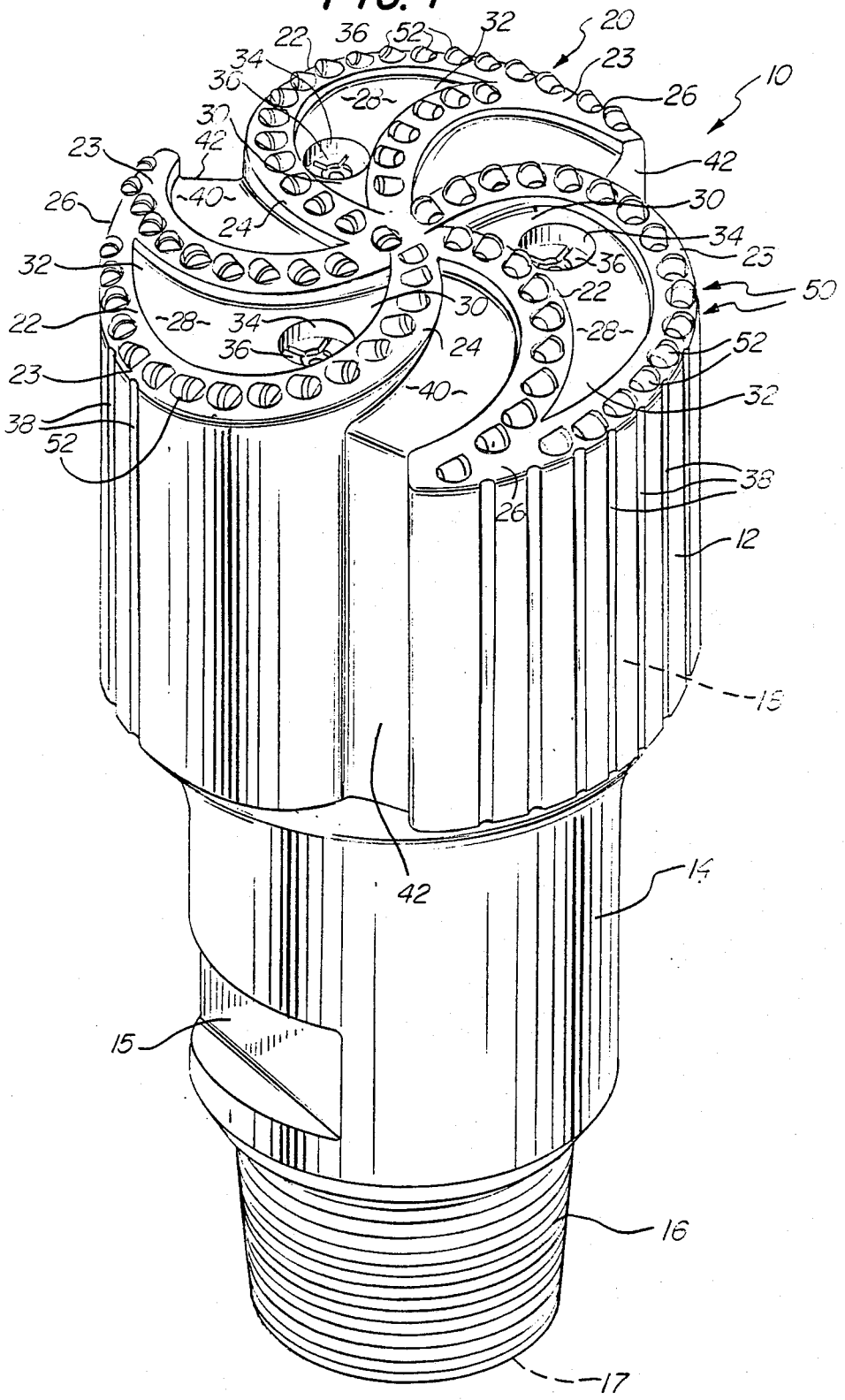
FIG. 1 is a perspective view of a preferred embodiment of the present invention, illustrating the spirally oriented plenum chambers separated and confined by diamond cutter containing raised lands.

Turning now to FIG. 1, the diamond drag bit, generally designated as 10, consists of a drag bit body 12, shank 14, pin end 16, and a cutting end 20. A pair of wrench flats 15 are formed in the shank portion of the bit 10. The wrench flats are designed to accommodate a bit breaker (not shown) used to disconnect pin end 16 from a drillstring (also not shown).

The cutting end, generally designated as 20, of bit 10 consists of a series of raised lands 22, formed by the face of the bit. Raised lands 22 are joined in pairs near the centerline of the bit body 12 and at the peripheral edge or gage 21 of the bit 10, forming plenum chambers 28 thereby. The peripheral edge 21 also forms the gage of the bit 10. Each plenum chamber 28 has at least one port 34 which communicates with an internal reservoir chamber 18 (FIG. 3) formed by the bit body 12. Replaceable nozzles 36 may be engaged with each of the ports 34 formed in the chamber areas of the bit face 20.

The raised lands 22 are preferably shaped in a spiral pattern, pairs of which form a leading edge 24 and a trailing edge 26. The plenum chamber 28 may be further refined by tapering the depth of the chamber from a deep inboard area 30 to a more shallow outboard area 32 nearest the gage 21 of the bit body 12. With a clockwise rotation of the drag bit in a borehole, fluid escapes or is accelerated through nozzle 36 into plenum chamber 28, the turbulent fluid being further accelerated from the leading edge 24 towards the trailing edge 26 of the spirally shape chamber. Fluid picks up impetus both through centrifugal force and the rotational speed of the bit. The tapering flow path defined between the bottom of the plenum chamber 28 and a borehole bottom formation 51 (FIG. 4) assures further fluid accelerated through this narrowing gap prior to escaping past diamond cutters 52 to the outside of the bit.

A multiplicity of equally spaced and strategically positioned cutters, generally designated as 50, are mounted onto a planar surface 23 formed by the raised lands 22. The cutters 50 may be selected from varying materials and compositions, some of which will be set forth in detail in the following specification.

Figure 4:
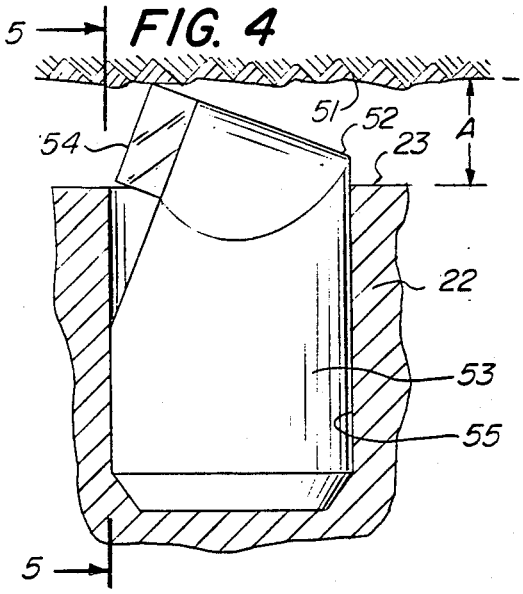
FIG. 4 is a side view of a diamond cutter blank mounted to a stud which is pressed into the raised lands formed on the cutting face of the bit.
Figure 5:
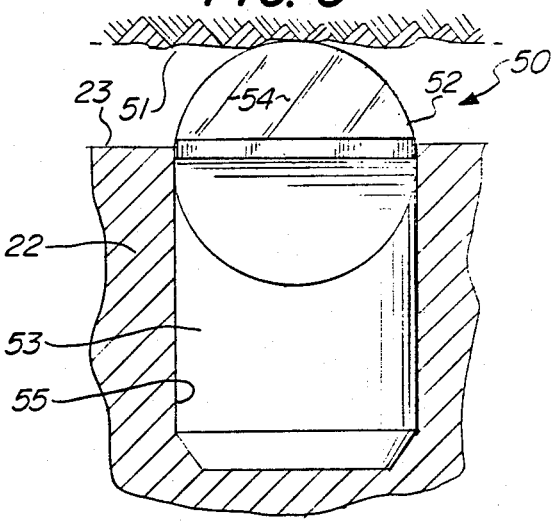
FIG. 5 is a front view taken through 5—5 of FIG. 4 illustrating a half-round polycrystalline diamond compact mounted to a cutter stud.

Referring specifically to FIGS. 4 and 5, a preferred cutter 52 consists of a half-diameter polycrystalline diamond compact metallurgically bonded to a tungsten carbide stud that is pressed or interference fitted into a complementary insert hole 55 formed in the planar surface 23 of raised land 22. These types of inserts, particularly those shown in FIGS. 4 through 7, are STRATAPAX inserts, developed by General Electric Company of Worthington, Ohio. Referring again to FIG. 1, the STRATAPAX type inserts 52, with their half-diameter polycrystalline diamond cutters mounted to the stud, enable the planar surface 23 of raised lands 22 to maintain a relatively narrow gap (shown as A in FIG. 4) between the planar surface 23 and a formation borehole bottom indicated as 51. The height of the diamond cutter and the distance the fluids must travel from the high pressure plenum to the low pressure annulus surrounding the bit completely determines the behavior of the fluid as it escapes the plenum chamber 28. This parameter is the most critical aspect of the present invention. The borehole bottom, of course, closes out the chamber 28, enabling the turbulent fluid flow to be accelerated over the planar surface 23 past each of the equidistantly spaced cutters 52 fixed within the raised lands 22.

Low pressure collector channels or grooves 40 are shown positioned substantially parallel to the raised lands 22. The low pressure collector grooves serve to collect detritus and low pressure fluid escaping past the cutters to the outside of the rock bit. Each of the three low pressure collectors shown dump into enlarged gage relief slots or channels 42 axially aligned along the outer wall 13 of bit body 12.

In addition to the major gage relief channels 42 a multiplicity of axially aligned escape slots 38 are formed in wall 13 adjacent the gage surface 21 of bit body 12. The multiplicity of axially aligned and equidistantly spaced slots 38 serve to receive high pressure hydraulic fluid escaping past the gage cutters 52 from plenum 28, thus providing a further path for detritus and low pressure hydraulic fluid to escape up the borehole to the rig floor.

Figure 2:
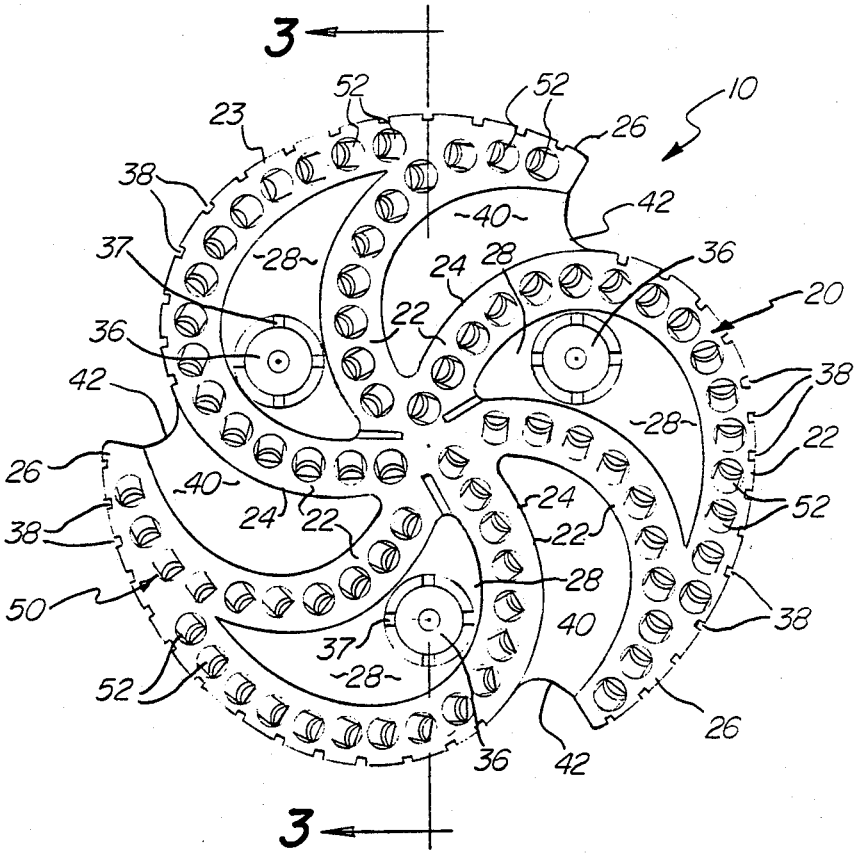
FIG. 2 is a top view of the diamond drag bit cutter, clearly illustrating each of the plenum chambers ringed by diamond compacts cutters, each of the chambers having a nozzle positioned therein.
Figure 3:
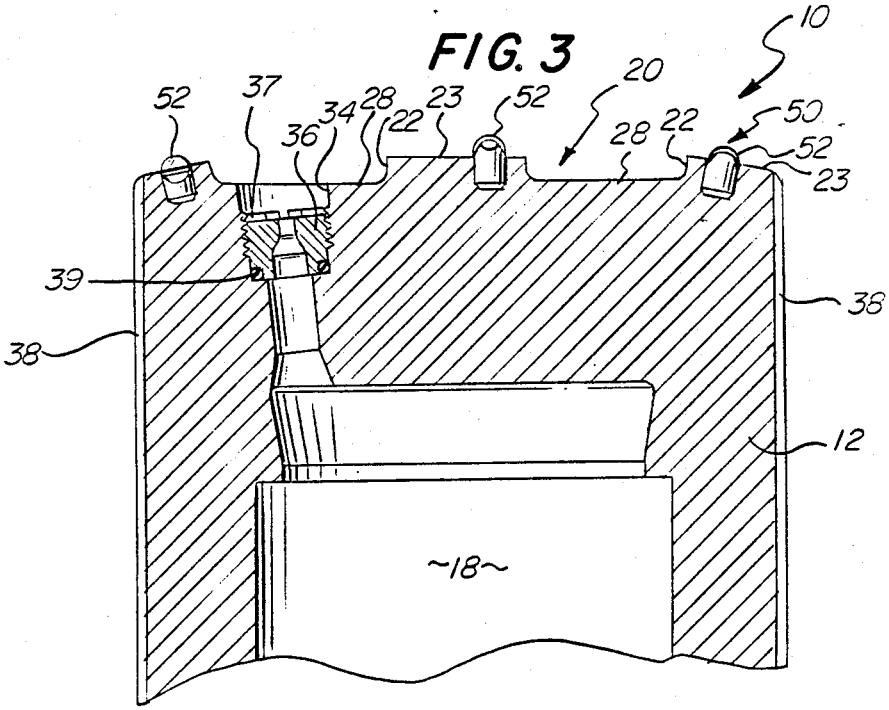
FIG. 3 is a partially broken away cross-sectional view taken through 3—3 of FIG. 2 illustrating the drag bit and the means in which fluid is directed from a chamber formed by the bit body through a nozzle.

Turning now to FIG. 2, the cutting face 20 of the diamond drag bit 10 defines preferably three pairs of spirally oriented raised lands 22. The inboard ends of a pair of raised lands 22 connects towards the centerline of the drag bit while the radially outwardly extending pairs of raised lands connect again at the peripheral edge or gage 21 of the bit body 12. A multiplicity of cutting element 50 are equidistantly spaced around the entire perimeter of each of the plenum chambers 28 formed in the bit face 20. It can readily be realized in the view depicted in FIG. 2 that almost half of the diamond cutters 52 are on gage 21 of the cutter 10. This feature assures that the bit maintains "in gage" (a minimum borehole diameter) during the full operating range of the bit. By entirely surrounding an enclosed plenum chamber with, for example, equidistantly spaced diamond cutters the entire formation borehole bottom is assured of being cut without leaving kerfs and valleys in the borehole bottom. A nozzle 36 is installed in each of the ports 34 to direct a stream of hydraulic fluid into chamber 18 (FIG. 3). The fluid enters a channel 33 leading from chamber 18 to the nozzle 36. Obviously the nozzle 36 may have different throat diameters so that the bit may be tailored to match different rock formations and hydraulic energy available to the bit. Again, the spirally shaped plenums direct accelerated hydraulic fluid outwardly in all directions past the multiplicity of diamond cutters extending beyond the planar surface 23 of raised lands 22. As stated before, the plenum chamber 28 is preferably tapered from a relatively deep portion 30 near the centerline of the bit to a relatively shallow area 32 nearest the peripheral edge or gage 21 of the bit. The tapering feature of the plenum from deep to shallow, as well as the rotational and centrifugal energy imparted to the diamond bit through the drillstring assures high flow velocities as well as uniform flow to all the diamond cutters. Thus, the diamond cutters are adequately cooled and cleaned and the borehole bottom scavenged to assure the best possible penetration rate of the bit 10 as it works in a borehole therefore minimizing high temperature degradation of the diamond cutters to maximize cutter life.

The partially cutaway cross section of FIG. 3 illustrates the replaceable nozzles 36 which, for example, have at their exit end a series of slots 37 to accept a tool for nozzle installation (not shown). Each nozzle typically has an O-ring 39 at its base to prevent internal nozzle erosion. Again, the nozzles feed fluid into the plenum chambers 28, the turbulent flow of fluid being channeled between the bottom of the plenum chamber and the borehole bottom 51 as shown in FIG. 4.

For practical purposes, the number of raised lands 22 is divisible by twos and are arranged so that the bit cutting face 20 is divided into alternating lands and valleys or grooves. For example, every other pair of raised lands 22 are joined at the outside diameter or gage 21 of the bit 10, closing the valley (forming plenum chamber 28) between the two raised lands 22. The plenums 28 cover about eighty to ninety percent of the borehole bottom 51 radially, which equates to about forty to fifty percent of the borehole bottom area. This abundant coverage of borehole bottom permits the highly turbulent fluid confined within the chambers 28 to continually scrub and scavenge the hole bottom 51, presenting virgin rock formation surfaces for the cutting elements 50 to engage and resulting in higher rates of rock bit penetration.

Figure 6:
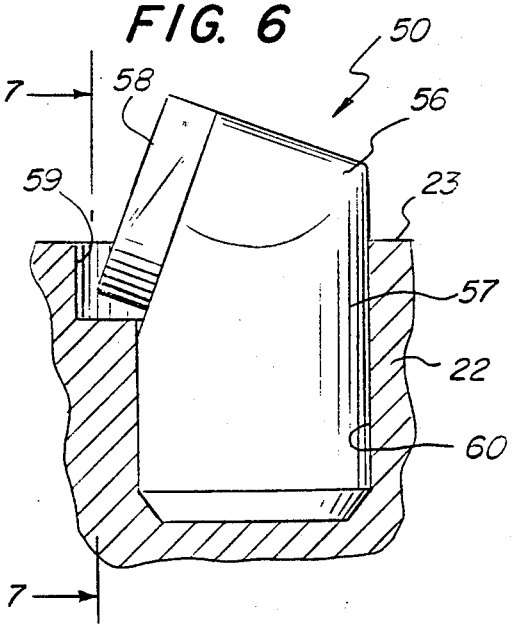
FIG. 6 is another embodiment of a diamond cutter mounted in the raised lands.
Figure 7:
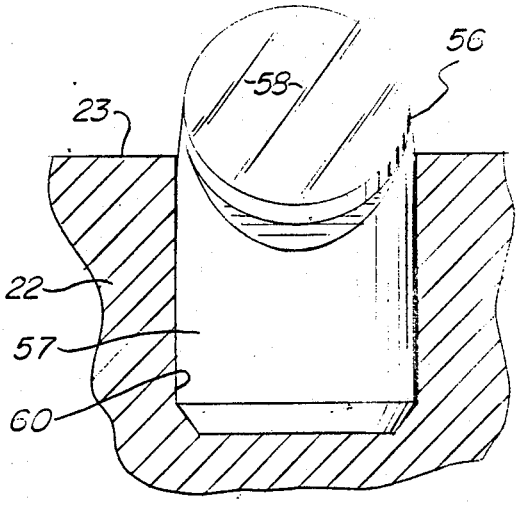
FIG. 7 is a view taken through 7—7 of FIG. 6 showing a full faced polycrystalline diamond compacts mounted to a stud.

Turning now to FIGS. 4 through 10, the preferred STRATAPAX type cutter 52 is shown with a half-circular polycrystalline diamond compact 54 metallurgically bonded to a stud 53 that is typically fabricated from tungsten carbide. The stud is interference fitted within a hole drilled through planar surface 23 of raised lands 22. These inserts are set deeply within the raised lands 22, thus the cutting edge exposure beyond planar surface 23 is minimized. This feature minimizes the gap between the face 20 of the bit 10 and the formation bottom 51. FIG. 5 shows a front view of the half polycrystalline diamond compacts 54 as it extends above planar surface 23. FIG. 6 illustrates a typical STRATAPAX type cutter 56 having a full 360° diamond compact 58 metallurgically bonded to a stud body 57, the body being interference fitted within a hole 50 drilled in raised lands 22. A counterbore 59 allows the bottom portion of the diamond compacts to be positioned below the planar surface 23, thus minimizing the cutter extension beyond the planar surface while providing backup support for the tungsten carbide stud body 57. FIG. 7 shows a front view of the full compacts and its relationship with planar surface 23 of raised lands 22.

Figure 8:
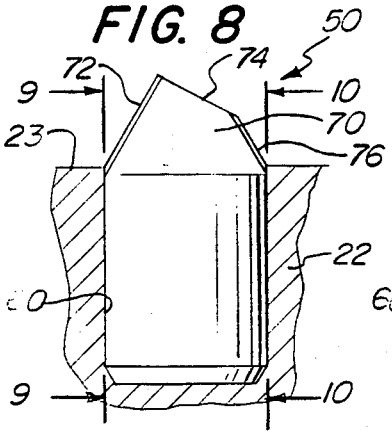
FIG. 8 is yet another variety of diamond cutter wherein the cutter is self-sharpening, having first and second diamond faces on a supporting stud.
Figure 9:
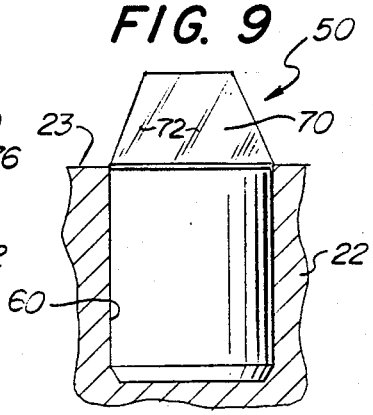
FIG. 9 is a view taken through 9—9 of FIG. 8 showing the larger cutting face of the diamond cutter.
Figure 10:
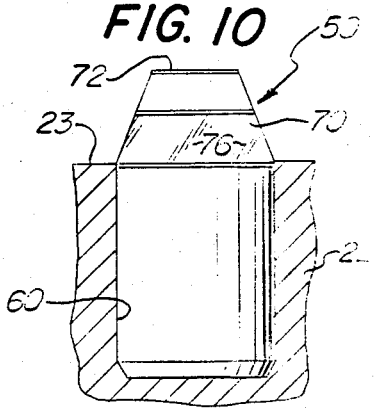
FIG. 10 is a view taken through 10—10 of FIG. 8 illustrating the back side of the self-sharpening cutter mounted to a raised land formed in the cutting face of the bit.

FIGS. 8 through 10 illustrate a different embodiment of a cutting element. The cutting element 70 is basically formed from a tungsten carbide body. The cutting end of the tungsten carbide cutter 70 is coated with a layer or layers of diamond surface 72. A diamond cutting side or leading edge side 72 and a trailing diamond surface 76 is formed on the stud body 70. The area 74 between the diamond surfaces 72 and 76 is tungsten carbide devoid of the diamond coating composition. In principle, the cutter is self-sharpening since the tungsten carbide material 74 is less hard than the diamond surfaces 72 and 76. The tungsten carbide wears away faster than the diamomd cutting surfaces 72 and 76, therefore providing the "self-sharpening" feature. FIG. 9 shows the front or leading cutting portion 72 which, of course, extends beyond surface 23 of raised lands 22. FIG. 10 shows the back view illustrating both the diamond layers 76 and 72 with intermediate tungsten carbide 74 therebetween. The insert is interference fitted within hole 60 formed in raised lands 22.

Other types of cutters 50 may be incorporated on or within planar surface 23 of raised lands 22. For example, a multiplicity of chisel type tungsten carbide inserts, well known in the rock bit industry, may be inserted in the raised lands (not shown).

Moreover, thermally stable polycrystalline diamond (PCD) cutters may be incorporated that are, for example, anchored within a tungsten carbide matrix applied to the cutter face 20 of the bit 10. These PCD cutters may be shaped in cylinders, cubes and triangles for optimum rates of penetration (not shown).

In addition, natural diamonds may be set in a tungsten carbide matrix and disbursed in random fashion on the planar surface 23 of raised lands 22.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A drag type drilling bit comprising:

a bit body forming a first pin end and a second cutting end, said first pin end is open to drilling fluid that is transmitted through an attachable drillstring, the pin end communicates with a fluid chamber formed by said bit body, at least two pairs of substantially radially disposed raised lands are formed by said second cutting end of said bit, said raised lands being joined near an axial centerline of said bit and adjacent an outer peripheral edge of said bit body thereby forming at least a pair of plenum chambers thereby, said plenum chambers being spirally disposed, said plenum chambers taper in depth radially from the center of the bit to the outer peripheral edge of the bit, said plenum chambers being surrounded by a low pressure area in a borehole annulus surrounding the bit;

a multiplicity of cutting elements are strategically positioned and fixedly attached to the raised lands; and one or more ports are formed in said second cutting end of said bit body, said ports communicate between said chamber formed by said bit body and the plenum chambers formed by said raised lands, said fluid exits said one or more ports and is distributed within said plenum chambers thereby scavenging a borehole bottom while uniformly cooling and cleaning said multiplicity of cutting elements during drag bit operation in said borehole.

2. The invention as set forth in claim 1 wherein the plenum chambers taper in depth from a leading edge formed by said raised lands nearest said axial centerline of said bit to a trailing edge formed by said raised lands nearest said outer peripheral edge of said bit.

3. The invention as set forth in claim 1 wherein the plenum chambers cover about fifty percent of the borehole bottom area.

4. The invention as set forth in claim 1 wherein said cutting end forms three plenum chambers, said plenum chambers cover about ninety percent of the borehole bottom in a radial direction from said axial centerline of said bit.

5. The invention as set forth in claim 4 wherein the three plenum chambers cover about fifty percent of the borehole bottom area.

6. A drag type diamond drilling bit comprising:

a bit body forming a first pin end and a second cutting end, said fist pin end is open to drilling fluid that is transmitted through an attachable drillstring, the pin end communicates with a fluid chamber formed by said bit body, at least six substantially radially disposed raised lands are formed by said second cutting end of said bit, one pair each of raised lands being contained in one hundred and twenty degree radial segments formed by said second cutting end, each pair of said raised lands being joined near an axial centerline of said bit and adjacent a peripheral edge of said bit, said joined raised lands forming three plenum chambers thereby, each of said plenum chambers is spirally disposed, said plenum chambers taper in depth from a leading edge formed by said raised lands nearest said axial centerline of said bit to a trailing edge formed by said raised lands nearest said outer peripheral edge of said bit, said plenum chamber being surrounded by a lower pressure area in a borehole annulus surrounding the bit;

a multiplicity of diamond cutting elements are strategically positioned and fixedly attached to the raised lands, said cutting elements protruding beyond a planar face formed by said raised lands such that a minimum space is formed between said cutting elements and a borehole bottom of said borehole; and at least one nozzle is attached within at least one port formed in said second cutting end of said bit body, said port communicates between said chamber formed within said bit body and the plenum chambers formed by said raised lands, said fluid exits and nozzle and is distributed within said plenum chamber thereby scavenging said borehole bottom while uniformly cooling and cleaning each of said multiplicity of cutting elements, said fluid being accelerated past said cutting elements through said minimum space formed between said cutting elements and said borehole bottom during drag bit operation.

* * * * *